US005459118A

United States Patent [19]

Dai et al.

[11] Patent Number: 5,459,118

[45] Date of Patent: Oct. 17, 1995

[54] HYDROTALCITE-CONTAINING CATALYST COMPOSITION

[75] Inventors: Pei-Shing E. Dai, Port Arthur; David E. Sherwood, Jr., Beaumont; Randall H. Petty, Port Neches, all of Tex.

[73] Assignee: Texaco Inc., White Plains, N.Y.

[21] Appl. No.: 240,413

[22] Filed: May 9, 1994

Related U.S. Application Data

[62] Division of Ser. No. 47,900, Apr. 19, 1993, Pat. No. 5,340, 466.

[51] Int. Cl.[6] ..... B21J 23/00

[52] U.S. Cl. ..... 502/300; 502/305; 502/317; 502/325

[58] Field of Search ..... 208/216 R, 217, 208/230; 502/300, 305, 317, 325

[56] References Cited

U.S. PATENT DOCUMENTS

| | | | |
|---|---|---|---|
| 3,956,105 | 5/1976 | Conway | 208/111 |
| 4,132,632 | 1/1979 | Yu et al. | 208/216 |
| 4,140,626 | 2/1979 | Bertolacini et al. | 208/216 R |
| 4,889,615 | 12/1989 | Chin et al. | 208/113 |

*Primary Examiner*—Michael Lusignan
*Attorney, Agent, or Firm*—Kenneth R. Priem; Cynthia L. Kendrick

[57] ABSTRACT

Hydrodesulfurization of a cracked naphtha is effected in the presence of, as catalyst, an alkali metal, a metal of Group VIII, and a metal of Group VI-B on an alumina support containing a hydrotalcite-like composition.

5 Claims, No Drawings

HYDROTALCITE-CONTAINING CATALYST COMPOSITION

This is a division of U.S. application Ser. No. 08/047,900, filed Apr. 19, 1993, now U.S. Pat. No. 5,340,466.

FIELD OF THE INVENTION

This invention relates to hydrodesulfurization of cracked naphtha. More particularly it relates to a process for selectively hydrodesulfurizing cracked naphtha in the presence of a catalyst.

BACKGROUND OF THE INVENTION

As is well known to those skilled in the art, cracked naphtha (obtained as product of a cracking operation or a coking operation) may contain a significant quantity of sulfur—up to as much as 13,000 wppm; and this material contributes a substantial quantity of undesired sulfur to the gasoline pool to which it is commonly passed. It is possible to decrease the sulfur content by (i) hydrotreating the whole feedstock to the cracking/coker unit or (ii) hydrotreating the product naphtha from these units.

The first noted alternative is a "brute force" effort that is very expensive in that it requires a large hydrotreater and it consumes significant quantities of hydrogen. The second-noted alternative is a more direct approach—but unfortunately it results in undesirable saturation of the olefins (typically originally present in amount of 20 v %–60 v %) and down to levels as low as 2 v %; and this reduces the octane number (Octane Number is the average of the Research Octane Number RON and the Motor Octane Number MON) of the product gasoline by as much as 10–20 units. Prior art desulfurization of full range FCC naphtha from 300 wppm down to 20 wppm of sulfur results in a typical decrease in octane number by about 14 units. This loss in octane number associated with desulfurization has a significant impact on the octane number of the refinery gasoline pool.

Typical prior art disclosures which are directed to hydrodesulfurization include:

U.S. Pat. No. 4,140,626 (Bertolacini and Sue-A-Quan) describes a selective hydrodesulfurization process employing a catalyst with a Group VIB metal and a Group VIII metal deposited on a support consisting of at least 70 wt % magnesium oxide (MgO). Preferably, the Group VI-B metal is molybdenum and the Group VIII metal is cobalt. Catalyst A (a catalyst of the invention of Bertolacini et. al.) contains 3 wt % COO/~16 wt % MoO3 on a pure MgO support. Catalyst B is a sample of commercial Criterion HDS-2A CoMo on alumina hydrotreating catalyst (with similar levels of CoO and $MoO_3$). Catalyst A is better than Catalyst B for hydrodesulfurization (HDS). In addition, catalyst A produces better octane numbers than Catalyst B at equivalent values of HDS (in the range of 75–85% HDS); however, the improvement is only ~1.5 octane numbers. Surprisingly, for both catalysts, olefin saturation was fairly low (<~40 wt %) and octane penalties were fairly insignificant (<~2 octane numbers) for the ranges of HDS studied. Other catalysts of the invention (prepared on supports with at least 70 wt % magnesium oxide) give HDS improvements.

U.S. Pat. No. 4,132,632 (Yu and Myers) is very similar to the above described patent except that the metal loadings are restricted to 4–6 wt % for the Group VI-B metal and 0.5–2 wt % for the Group VIII metal. Again, preferably, the Group VI-B metal is molybdenum and the Group VIII metal is cobalt. Catalyst I (a catalyst of Yu et al) is ~1 wt % COO/~5 wt % $MoO_3$ on a pure MgO support. Catalyst II contains ~3 wt % COO/~17 wt % MoO3 on a support comprising 80 wt % MgO (i.e. a catalyst of U.S. Pat. No. 4,140,6626 supra). Catalyst I generally gives poorer HDS than Catalyst II, but Catalyst I gives less olefin saturation and better octane numbers at around the same level of HDS (~82–84%). The incremental octane improvement is small (~1.6 octane numbers). Again, for both catalysts, olefin saturation is fairly low (<~40 wt %) and octane penalties are fairly insignificant(<~2.6 octane numbers) for the ranges of HDS studied.

A paper entitled "DESULFURIZATION OF CAT CRACKED NAPHTHAS WITH MINIMUM OCTANE LOSS" presented at the 1978 NPRA Annual Meeting in San Antonio, Texas by Coates, Myers and Sue-A-Quan sets forth a good overview of the development of what Amoco called their "Selective Ultrafining Process." The paper was presented about one year before the above described patents issued. The paper mentions two catalysts (presumably from the two patents). Sulfiding technique is mentioned as a major concern. The new catalysts show lower rates of deactivation than standard hydrotreating catalysts for HDS. Incremental octane improvements are said to be 4 MON and 4.5 RON at 90% HDS. The incremental octane improvements of the presentation were much larger than those shown in the subsequent Amoco patents.

GB 2,225,731 discloses hydrotreating catalysts comprising Group VI and Group VIII metal hydrogenation components on a support which comprises magnesia and alumina in a homogeneous phase. The mole ratio of Mg to Al is 3–10:1. The catalyst is said to have comparable HDS activity to similar catalysts based on alumina.

Additional background may be noted from:

(i) U.S. Pat. No. 3,539,306 to Kyowa Chemical Industry Co. as assignee of Kumura et al;

(ii) U.S. Pat. 3,650,704 to T. Kumura et al;

(iii) Cavani et al *Anionic Clays with Hydrotalcite-like Structure as Precursors of Hydrogenation Catalysts* Mat. Res. Soc. Extended Abstracts" (EA-24)—Pub by Materials Research Society; and (iv) O. Clause et al *Preparation and Thermal Reactivity of Nickel/Chromium and Nickel/Aluminum Hydrotalcite-type Precursors* Applied Catalysts 73. (1991) 217–236 Elsevier Science Publishers;

(v) Eur. Pat. Application 0 476 489 A1 to Haldor Topsoe A/S as assignee of E. G. Derouane et al;

(vi) U.S. Pat. No. 3,705,097 issued Dec. 5, 1972 to Dow Chemical Co. as assignee of B. D. Head et al;

(vii) U.S. Pat. No. 3,956,105 issued May 11, 1976 to Universal Oil Products as assignee of J. E. Conway.

(viii) U.S. Pat. No. 4,962,237 issued Oct. 9, 1990 to Dow Chemical Company as assignee of D. E. Laycock.

The conventional catalysts for naphtha hydrotreating include CoMo, NiMo, NiW, CoMoP, and NiMoP metal oxides supported on gamma alumina typified by the commercial Criterion C-444 CoMo hydrotreating catalyst. Magnesia supported catalysts and silica-magnesia supported catalysts are disclosed in U.S. Pat. Nos. 2,853,429 and 3,269,938 respectively. The commercial BASF K8-11 catalyst, used in the water gas shift conversion, generally contains 4 wt % CoO and 10 wt % $MoO_3$ on a magnesia-alumina-silica support. Contrary to the claimed advantages of the above-described Amoco patents and paper, one of the common drawback of catalysts on magnesia-containing supports is the low HDS activity compared to alumina (particularly gamma alumina) supported catalysts. It is commonly believed that the low surface area of magnesia-containing supports and the poor dispersion of $MoO_3$ on magnesia-containing supports are the cause of the low HDS activities.

It is an object of this invention to provide a novel hydrodesulfurization process. It is another object of this invention to provide a magnesium-containing catalyst with a very high hydrodesulfurization activity. Other objects will be apparent to those skilled in the art.

STATEMENT OF THE INVENTION

In accordance with certain of its aspects, this invention is directed to a process for selective hydrode-sulfurization of a cracked naphtha containing paraffins, isoparaffins, aromatics, naphthenes, and olefins which comprises maintaining in a reaction zone a bed of catalyst containing an alkali metal, a non-noble Group VIII metal, and a metal of Group VI-B on an inert support containing a hydrotalcite-like composition;

passing said cracked naphtha containing paraffins, isoparaffins, aromatics, naphthenes, and olefins to said reaction zone and into contact with said bed of catalyst;

maintaining said bed of catalyst at hydrode-sulfurizing conditions thereby producing a product stream of hydrodesulfurized cracked naphtha; and recovering said product stream of hydrode-sulfurized cracked naphtha.

DESCRIPTION OF THE INVENTION

The charge which may be treated by the process of this invention may be a naphtha, typically a full range naphtha which is recovered from a cracking or coking unit. Typically the cracked naphtha will be recovered from a fluid catalytic cracking (FCC) unit. The charge naphthas which may be treated may be characterized by the following properties:

TABLE

| Condition | Broad | Preferred | Typical |
|---|---|---|---|
| API | 50–76 | 52–60 | 58 |
| Boiling Range °F. | | | |
| ibp | 50–240 | 90–200 | 95 |
| 10 v % | 120–260 | 145–225 | 145 |
| 50 v % | 200–310 | 210–286 | 210 |
| 90 v % | 300–380 | 305–360 | 351 |
| ep | 320–438 | 360–420 | 400 |
| Sulfur (wppm) | 300–13,000 | 1100–10,000 | 2,000 |
| Paraffins plus isoparaffins v % | 25–40 | 30–38 | 36 |
| Aromatics v % | 5–25 | 8–20 | 15 |
| Naphthenes v % | 5–20 | 10–19 | 16 |
| Olefins v % | 20–60 | 25–45 | 33 |
| RON | 60–95 | 73–93 | 91 |
| MON | | | |

In practice of the process of this invention, the charge naphtha is passed to a bed of hydrodesulfurization catalyst. Although it may be possible to utilize a fluid bed or an ebullated bed, it is preferred to utilize a gravity packed bed.

The catalyst is formed on a support which contains 40 parts-99 parts, preferably 50 parts-85 parts, say 75 parts of inert composition—typically metal oxide-type support such as silica, silica-alumina, magnesia, titania, etc. The preferred support is alumina, preferably gamma alumina.

There is mixed with the support, a hydrotalcite-like composition of the formula $$[X_aY_b(OH)_c]_n[A]_d e\cdot H_2O$$

a=1–10
b=1–10
c=2(a+b)=4–40
A is an anion of formal negative charge n
n=an integer 1–4
d is the formal positive charge of $[X_a, Y_b(OH)_c]$
e=1–10
X is a divalent metal
Y is a trivalent metal of Group III or Group VI-B or non-noble Group VIII of the Periodic Table.

subject to the qualification that when one of d or n is an integral multiple of the other, they are both reduced to lowest integral terms.

The metal X may be a Group II-A metal such as beryllium (Be), magnesium (Mg), calcium (Ca): strontium (Sr), barium (Ba), or radium (Ra). The preferred metal is magnesium (Mg). More than one metal X may be present.

The metal Y may be boron (B), aluminum (Al), gallium (Ga), indium (In), or thallium (Tl) of Group III or iron Fe, cobalt Co, or nickel Ni of non-noble Group VIII or chromium Cr, molybdenum Mo, or tungsten W of Group VI-B. The preferred metal is aluminum (Al). More than one metal Y may be present.

a may be 1–10, preferably 3–6, say 4.5.

b may be 1–10, preferably 1–3, say 2.

c may be 4–40, preferably 10–16, say 13.

n may be an integer 1–4, preferably 1–2, say 2.

d may be 1–4, preferably 1.

e may be 1–10, preferably 3–4, say 3.5

A may be an anion such as $CO_3^=$, halogen e.g. Cl—, acetate $C_2H_3O_2$—, oxalate $HC_2O_4$= or $C_2O_4^=NO_3^-$, $SO_4^=$, or $ClO_4^-$. The preferred anion may be $CO_3^=$.

Illustrative hydrotalcite-like (HTlc) compositions may be those noted in the following table—the first listed (hydrotalcite (HT) itself), as available under the designation DHT-4A, being preferred:

TABLE $[Mg_{4.5}Al_2(OH)_{13}][CO_3]^{\cdot 3.5.H_2O}$
$[Mg_6Al_2(OH)_{16}][CO_3]^{\cdot 4.H_2O}$
$[Mg_6Al2(OH)16][NO_3]^{\cdot 4.H_2O}$
$[Ca_6Al2(OH)16][SO_4]^{\cdot 4.H_2O}$
$[Zn3Cr(OH)_8][NO_3]^{\cdot 4.H_2O}$
$[Ni5Al2(OH)_{14}][NO_3]_2^{\cdot 4.H_2O}$
$[Mg_4Fe(OH)10][NO_3]^{\cdot 4.H_2O}$ Hydrotalcite $[Mg_6Al_2(OH)_{16}CO_3\cdot 4H_2O]$ is a hydroxycarbonate of magnesium and aluminum and occurs naturally in the Urals of the Soviet Union and also in Snarum, Norway. In Kyowa Chemical Industry Co., Ltd. succeeded in the world's first industrial synthesis of hydrotalcite. (U.S. Pat. Nos. 3,539,306 and 3,650,704). DHT-4A $[Mg_{4.5}Al_2(OH)_{13}CO_3.\ 3.5H_2O]$ is a hydrotalcite-like compound. The first papers in the literature referring to hydrotalcite-like compounds appeared in 1971, written by Miyata et al., dealing with basic catalysts (S. Miyata et al., Nippon Kagaku Zasshi, 92 (1971) 514) and in 1977 by Miyata (S. Miyata, Kogaku Gijutsushi Mol, 15 (10) (1977) 32 and 15 (3) 1971 31).

The preparation, properties and applications of hydrotalcite-type anionic clays are reviewed by F. Cavani et. al. in CATALYSIS TODAY, Vol. 11, No. 2, 1991. The properties of the DHT-4A product are detailed in the data sheets provided by Kyowa Chemical. The natural product of calcination or activation in inert gas of a HTlc is believed to be a spinel. In the range between the temperature at which HTlc decomposition commences (between 572° and 752° F.) and that of spinel formation (1652° F.), a series of metastable phases form, both crystalline and amorphous. Therefore, the surface area, pore volume, and structure depend on the temperature of calcination. Upon calcination, the crystal structure of DHT-4A is decomposed at about 660° F. when water and carbon dioxide evolved from the structure, and a $MgO-Al_2O_3$ solid solution of formula 4.5 $MgO.Al_2O_3$ is formed. This solid solution is stable up to 1472° F. MgO and $MgAl_2O_4$ are formed at about 1652° F. On the other hand, the solid solution calcined at less than 1472° F. can be restored to the original structure by hydration.

The most interesting properties of the calcined HTlc are 1) high surface area, 2) basic properties, and 3) formation of homogeneous mixtures of oxides with very small crystal size. Miyata et al., showed that there is a maximum in the number of basic sites when the HTlc is calcined at 932° F. Nakatsuka et. al. examined the effect of the Mg/Al ratio in the HT on the basic strength and the amount of basic sites. (Bull. Chem. Soc. Japan, 52 (1979) 2449). The number of basic sites increased with Mg/A1 ratio, while the number of acid sites decreased; however the compound with ratio $MgO/Al_2O_3$ of 5.23 exhibited the greatest number of basic sites per unit of surface area. The HTlc and the calcined HTlc have found applications in basic catalysis, hydrogenation of nitrobenzene, oxidation reaction, and support for Ziegler-Natta catalysts. U.S. Pat. No. 4,962,237 discloses a catalytic process for the preparation of polyols using the calcined DHT-4A.

The compositions may be readily available commercially from Kyowa Chemical Industry Co. Ltd. of Kagawa, Japan. The preferred composition is marketed under the trademark DHT-4A having the formula:

$$Mg_{4.5}Al_2(OH)_{13}CO_3.3.5H_2O$$

The catalyst support may be formed by mixing 10–840 parts, preferably 200–750 parts, say 300 parts of hydrotalcite-like composition with 360–1190 parts, preferably 500–1000 parts, say 900 parts of inert support, preferably 700–900 parts, say 800 parts of water and 5–40 parts, preferably 10–30 parts, say 24 parts of acid such as nitric acid. After mulling, the mixture is cast or extruded to form cylinders of diameter of about 0.8– 1.6mm, say 1.3 mm and length of 2.5–15 mm, say 3.8 mm. The cross-section of the particles is preferably trilobar.

The particles are dried at 220° F.–400° F., preferably 220° F.–300° F., say 220° F. for 10–30, preferably 12–24, say 16 hours and thereafter calcined at 1000° F.–1200° F., preferably 1050° F.– 1150° F., say 1100° F. for 0.2–3 hours, preferably 0.4–2 hours, say 0.5 hours.

The so-formed composition is typically characterized by the following properties:

TABLE

| Property | Broad | Preferred | Typical |
|---|---|---|---|
| Total Pore Vol. cc/g | 0.5–1 | 0.7–0.9 | 0.7 |
| Pore Size Dist. cc/g | | | |
| >1500 Å | 0.001–0.02 | 0.01–0.02 | 0.011 |
| >500 Å | 0.01–0.5 | 0.01–0.4 | 0.014 |
| >250 Å | 0.01–0.5 | 0.01–0.02 | 0.014 |
| >100 Å | 0.15–0.6 | 0.2–0.6 | 0.22 |
| <100 Å | 0.3–0.6 | 0.35–0.55 | 0.50 |

TABLE-continued

| Property | Broad | Preferred | Typical |
|---|---|---|---|
| Pore Mode Å | | | |
| dv/dD Max | 55–65 | 57–63 | 61 |
| BET | 55–65 | 60–65 | 63 |
| Total Surface Area $M^2/g$ | 200–350 | 220–335 | 330 |

Preparation of the catalyst of this invention is effected by contacting the support with preferably aqueous solutions of Group VI-B and non-noble Group VII metal. The non-noble Group VIII metal may be iron Fe, cobalt Co, or nickel Ni, preferably cobalt; and the metal may be added, in solution in amount sufficient to fill the pores of the support—preferably as an aqueous solution of a soluble cobalt salt such as the acetate, nitrate, carbonate, etc. The Group VI-B metal may be chromium Cr, molybdenum Mo, or tungsten W, preferably molybdenum, typically as the acetate, oxide, chloride, or carbonyl. Ammonium molybdate may be employed typically in aqueous solution.

The metals may be added simultaneously or sequentially. After addition, the support bearing the metals is dried at 50° F.–100° F., preferably 60° F.–90° F., say 70° F. for 0.5–24 hours, preferably 1–4 hours, say 2 hours and then at higher temperature of 220° F.–400° F., preferably 250° F.–300° F., say 250° F. for 1–8 hours, preferably 2–6 hours, say 4 hours. Thereafter the catalyst is calcined at 600° F.–1000° F., preferably 700° F.–900° F., say 800° F for 1–8 hours, preferably 2–6 hours, say 4 hours and thereafter at higher temperature of 800° F.–1200° F., preferably 900° F.– 1100° F., say 1010° F. for 0.5–5 hours, preferably 1–3 hours, say 2 hours.

It is a feature of the catalyst of this invention that it contains alkali metals of Group IA of the Periodic Table. Although the alkali metal may be sodium, lithium, cesium, or rubidium, it is preferably potassium. The alkali metal may be added as a soluble salt such as the acetate, oxalate, or preferably the hydroxide. Preferably the alkali metal oxide (potassium oxide $K_2O$) may be present in amount of 0.1–6 w %, typically 1.3–4.7 w %, say 2.3 w % of total catalyst. Metals including alkali metals are present and reported as metal oxide.

The alkali metal may be added at any time during preparation of the catalyst—either with one or both of the metals of Group VIII and VI-B or before or after. It is preferred that the alkali metal be added after the metals of Group VIII and VI-B have been calcined. The catalyst support bearing the metals of Group VIII, VI-B, and I-A is dried at 220°–400° F., preferably 250° F.– 300° F., say 250° F. for 0.5–24 hours, preferably 1–4 hours, say 2 hours and then calcined at 600° F.–1000° F., say 800° F. for 1–8 hours, preferably 2–6 hours, say 4 hours and thereafter at 800° F.–1200° F., preferably 900° F.–1100° F., say 1010° F., for 0.5–5 hours, preferably 1– 3 hours, say 2 hours.

The finished catalyst may be characterized as follows (parts by weight).

TABLE

| Property | Broad | Preferred | Typical |
|---|---|---|---|
| Inert Support | 30–99 | 40–80 | 60 |
| Hydrotalcite-like Composition | 1–70 | 20–60 | 19.7 |
| Group VIII | 0.1–6 | 1–5 | 3 |

TABLE-continued

| Property | Broad | Preferred | Typical |
|---|---|---|---|
| Group VI-B | 0.1–25 | 10–18 | 15 |
| Group I-A | 0.1–6 | 1.3–4.7 | 2.3 |

A preferred catalyst includes:

(i) 1–70w %, say 19.7 w %, of the DHT-4A (from Kyowa Chemical) synthetic hydrotalcite-like composition containing $Mg_{4.5}Al_2(OH)_{13}CO_3.3.5H_2O$ (ii) 30–99w %, say 60w %, of gamma alumina (iii) 0.1–6w %, say 3w %, of CoO (iv) 0.1–25w %, say 15w %. of $MoO_3$ (v) 1.3–4.7 w %, say 2.3w %, of $K_2O$ The percentage figures for CoO, $MOO_3$, and $K_2O$ are % of metal oxides in the finished catalyst wherein the metal is present in the form of oxide.

Selective hydrodesulfurization of cracked naphtha may be effected by passing a charge cracked naphtha in liquid phase through a gravity-packed bed of catalyst at the following input conditions:

TABLE

| Conditions | Broad | Preferred | Typical |
|---|---|---|---|
| Temp (°F.) | 450–700 | 500–670 | 550 |
| Total Pressure (psig) | 200–800 | 350–500 | 400 |
| $H_2$ Feed Rate SCFB | 500–2000 | 800–1500 | 1000 |
| $H_2$ Purity v % | 65–100 | 80–99 | 95 |
| LHSV | 1–10 | 2–7 | 5 |

During hydrodesulfurization, the sulfur content of the cracked naphtha is decreased from a charge level of 300–13,000 wppm, preferably 1100–10,000 wppm, say 2000 wppm down to a product level of 50–440 wppm, preferably 50–240 wppm, say 56 wppm.

It is a particular feature of the process of this invention that it is characterized by the following advantages:

(i) It permits attainment of satisfactory hydrodesulfurization activity. It is particularly to be noted that control Example XXV* using the prior art magnesia-containing catalyst only shows HDS of 39.5% whereas in Example XV using the instant catalyst shows HDS of 63.1% at the same temperature. See infra.

(ii) It permits attainment of these high levels of hydrodesulfurization under conditions such that decreased olefin saturation (OS) occurs at accompanying high level of hydrodesulfurization. For example, the instant process (Example XV) operating at 550° F. shows an HDS Activity of 38.2% accompanied by an Olefin Saturation of 7.5 while a control run (Example XXIII) operating at similar conditions shows HDS Activity of 41.1% at Olefin Saturation of 21.4. Thus the instant process shows comparable HDS Activity at an Olefin Saturation of only (7.5/21.4 or only about ⅓ that of the control.

HDS Activity is the percent hydrodesulfurization HDS measured for a standard sample in a standard hydrodesulfurization test charging a standard charge.

Olefin Saturation is measured by the FIA technique (ASTM D-1319) and by the PIONA/PIANO Analyses using gas chromatography techniques. The PIANO method (Paraffins, Isoparaffins, Aromatics, Naphthenes, and Olefins) has been found to be particularly suitable for measuring feed and product properties.

The product hydrodesulfurized cracked naphtha commonly has a sulfur content as low as 50–440 wppm, preferably 50– 240 wppm, say 56 wppm and the sulfur content is 67%–97%, preferably 83%–97%, say 95% lower than that of the charge. The olefin content of the product is typically 3–24 v %, preferably 5–24 v %, say 20 v %.

It is a feature of the process of this invention that the loss in octane number typically is less than that observed in prior art processes which may show a loss of as much as 14 units. The process of the instant invention permits operation with significantly lower loss—typically a loss of as little as 1–2 octane numbers in commercial practice.

Practice of the process of this invention will be apparent to those skilled in the art from the following examples wherein all parts are parts by weight unless otherwise specified. An asterisk (*) designates a Control Example.

DESCRIPTION OF SPECIFIC EMBODIMENTS

EXAMPLE I

In this example, the catalyst support is prepared by mixing:

(i) 3 pounds of DHT-4A powder (from the Kyowa Chemica Industry Co. Ltd. of Kagawa, Japan) having the formula $Mg_{4.5}Al_2(OH)_{13}CO_3.3.5H_2O$ and (ii) 9 pounds of alpha alumina monohydrate which contained 2 w % silica as a binder. The moisture content is adjusted by adding 8 pounds of deionized water and 108 ml of 70w % nitric acid.

The mixture is mulled to homogeneity and extruded into trilobe cylindrical pellets of maximum width of 1.3 mm and length of about 3.8 mm. The wet pellets are dried at 220° F. for about 16 hours and calcined at 1100° F. for 0.5 hours.

The Total Surface Area (TSA) of this support (BET) is 330 $m^2/g$ and the Total Pore Volume (TPV) by mercury porosimetry is 0.72 cc/g. This support contains 16 w % MgO and 84w % $Al_2O_3$.

Prior to impregnation, the support is dried again at 250° F. overnight (18 hours). The impregnating solution is prepared by dissolving 5.8 parts of ammonium molybdate in 20 parts of deionized water followed by adding 3.7 parts of cobalt nitrate hexahydrate at 140° F.

The ratio of total volume of impregnating solution to Total Pore Volume (as measured by mercury porosimetry) is about 0.97–1.05:1. Support (25g) is impregnated with 22 ml of solution. The wet support is permitted to stand at room temperature for 2 hours, dried at 250° F. for 4 hour, calcined at 800° F. for 16 hours, and finally calcined at 1010° F. for 2 hours.

The wet Co-Mo-containing support is dried at 250° F. for 2 hours and then impregnated with 15 ml of aqueous potassium hydroxide solution which contained 0.88 g of KOH. The so-impregnated support is dried at 250° F. overnite, calcined at 800° F. for 4 hours, and then at 1010° F. for 2 hours.

The composition and properties of the supports and the finished catalysts are set forth in the Tables infra.

EXAMPLE II

In this experimental Example, which represents the best mode presently known of carrying out the process of this invention, the procedure of Example I is duplicated.

EXAMPLE III

In this experimental Example, the procedure of Example I is followed except:

(i) the 50 w % DHT-4A/alumina support is prepared from pounds of DHT-4A/powder and 6 pounds of alpha alumina monohydrate powder and 66 ml of 70% nitric acid and 8 pounds of water. The resulting support has a TSA of 318 $m^2/g$, and a TPV of 0.92 cc/g. The catalyst support contains 32 w % MgO and 68 w % $Al_2O_3$.

(ii) 31 ml of impregnating solution is used rather than 22 ml as in Example I.

EXAMPLE IV

In this experimental Example, the procedure of Example I is repeated except that 0.44 g of KOH (in 22 ml of water) is added—to yield a finished catalyst containing 1.2 w % $K_2O$.

EXAMPLE V

In this experimental Example, the procedure of Example I is repeated except that 1.76 g of KOH (in 22 ml of water) is added—to yield a finished catalyst containing 4.7 w % $K_2O$.

EXAMPLE VI*

In this control Example, the procedure of Example I is repeated except that the support is not impregnated with potassium.

EXAMPLE VII*

In this control Example, the procedure of Example III is followed except that the support is not impregnated with potassium.

EXAMPLE VIII*

In this control Example, the gamma-alumina support is impregnated with the magnesium, cobalt, and molybdenum.

Gamma-alumina support (30 g), as cylinders of 1.2 mm diameter and 3.8 mm length, is impregnated with 300 ml of allyl magnesium chloride (166.4 ml) in tetrahydrofuran (133.6 ml). The so-treated support is dried overnight at 250° F., calcined for 4 hours at 600° F., and calcined for 4 hours at 800° F. The resulting support contains about 27.3 w % MgO and 72.7 w % $Al_2O_3$.

This support (25 g) is impregnated with 15 ml of aqueous solution containing 5.6 g of ammonium heptamolybdate and 3.5 g of cobalt nitrate hexahydrate. The wet support is dried and calcined in the same manner as in Example I.

EXAMPLE IX*

In this control Example, the support is a commercial available magnesia/alumina support of United Catalyst Inc. (UCI) made by mulling magnesium carbonate and alpha alumina monohydrate followed by extrusion. This support contains 80 w % magnesia and 20 w % alumina.

This support (25 g) is impregnated with aqueous impregnating solution (12 ml) containing 5.6 g of ammonium molybdate and 3.5 g of cobalt nitrate hexahydrate. The wet support is dried and calcined in the same manner as in Example I.

EXAMPLE X*

In this control Example, the catalyst is prepared in manner similar to the procedure of Example I—except that the support is gamma-alumina (containing no magnesium) which has been impregnated with 1 w % $Li_2O$ and thereafter loaded with 3 w % NiO and w % $MoO_3$.

EXAMPLE XI*

In this control Example, the catalyst is prepared in manner similar to the procedure of Example I—except that the support is gamma-alumina (25 g) which is impregnated with 23 ml of aqueous solution containing ammonium heptamolybdate (5.8 g) and cobalt nitrate hexahydrate (3.7 g). The wet extrudates are dried at 250° F. for 2 hours and then impregnated with aqueous solution (1.5 ml) containing potassium hydroxide (0.88 g). The catalyst is dried and calcined in the same manner as that of Example I.

EXAMPLE XII*

In this control Example, the catalyst is the commercially available BASF K8–11 catalyst containing 4.5 w % $Co_3O_4$ and 13.6 w % $MoO_3$ on a magnesia-alumina-silica support. The space velocity LHSV is 4.

EXAMPLE XIII*

In this control Example, the catalyst is the same as the catalyst of Example XII* containing 4.5 w % $Co_3O_4$ and 13.6 w % $MoO_3$ on a magnesia-alumina-silica support. The space velocity LHSV is one half that of Example XII*.

The following Table summarizes the metal loading and the Group IIA content of each of the catalysts. The metals are expressed as % metal based on total catalyst weight. The metals are actually present as oxides.

TABLE

| Example | VIII w % | VI-B w % | I-A w % | II-A w % |
|---|---|---|---|---|
| I | 3 | 15 | 2.3 | 13 |
| II | 3 | 15 | 2.3 | 13 |
| III | 3 | 15 | 2.3 | 26 |
| IV | 3 | 15 | 1.2 | 13 |
| V | 3 | 15 | 4.7 | 13 |
| VI* | 3 | 15 | 0 | 13 |
| VII* | 3 | 15 | 0 | 26 |
| VIII* | 3 | 15 | 0 | 22 |
| IX* | 3 | 15 | 0 | 66 |
| X* | 3 | 15 | 0 | 0 |
| XI* | 3 | 15 | 2.3 | 0 |

Group VIII metal is cobalt or nickel (Ex X).

Group VI-B metal is molybdenum.

Group I-A metal is potassium or lithium (Ex X).

Group II-A metal is magnesium.

Each of the catalyst systems of Examples I-XIII* is tested in a standard hydrodesulfurization test. The catalyst is ground to 30–60 mesh size, dried in air at 850° F. for 2 hours, and a 0.5g sample is loaded into the reactor. Presulfiding is carried out at 750° F. for one hour with a gas stream containing 10v % $H_2S$ in hydrogen. The Model Feed is then admitted for 4 hours at the test temperature. The Model Feed contains 12 mol % (0.625 molar) benzothiazine in a blend of 67.5 mol % ASTM reagent grade n-heptane with 20.5 mol % 1-hexene. The average hydrodesulfurization activity (from two or more runs) is reported in units of %HDS.

In each Example, there are noted (i) the %HDS (which is correlative to the w % of sulfur removed from the charge) and (ii) the %OS (which indicates the w % of olefins in the charge which have been saturated).

Properties of the experimental supports and of the finished catalysts may be summarized as follows:

TABLE

| Property | Support Ex I | Support Ex II | Catalyst Ex I | Catalyst Ex II |
|---|---|---|---|---|
| DHT-4A w % | 25 | 25 | 19.7 | 19.7 |
| $K_2O$ w % | 0 | 0 | 2.3 | 2.3 |
| CoO w % | 0 | 0 | 3 | 3 |
| $MoO_3$ w % | 0 | 0 | 15 | 15 |
| MgO w % | 16 | 16 | 13 | 13 |
| TPV cc/g | 0.7212 | 0.7212 | 0.5477 | 0.5386 |
| PV > 1500Å cc/g | 0.0114 | 0.0114 | 0.0079 | 0.0064 |
| PV > 500Å cc/g | 0.0143 | 0.0143 | 0.0125 | 0.0112 |
| PV > 250Å cc/g | 0.0148 | 0.0148 | 0.0357 | 0.0211 |
| PV > 100Å cc/g | 0.2200 | 0.2200 | 0.1277 | 0.1207 |
| PV < 100Å cc/g | 0.5012 | 0.5012 | 0.4200 | 0.4179 |
| Pore Mode Å | | | | |
| dv/dD | 61 | 61 | 63 | 61 |
| BET | 63 | 63 | 63 | 62 |
| TSA $m^2/g$ | 330 | 330 | 250 | 276 |
| (I-A/Al) int | | | 0.015 | 0.01 |
| (VI-B/Al) int | — | — | 0.094 | 0.073 |
| (VIII/Al int | — | — | 0.020 | 0.020 |
| Mo Gradient | — | — | 2.0 | 3.2 |
| Co Gradient | — | — | 1.9 | 4.8 |

In all Tables, the internal ratio (int) is determined by XPS and the X Gradient=$(X/Al)_{ext}(X/Al)_{int}$

TABLE

| Property | Support Ex III | Catalyst Ex III | Support Ex IV | Catalyst Ex IV |
|---|---|---|---|---|
| DHT-4A w % | 50 | 40 | 25 | 20.2 |
| $K_2O$ w % | 0 | 2.3 | 0 | 1.2 |
| CoO w % | 0 | 3 | 0 | 3.0 |
| $MoO_3$ w % | 0 | 15 | 0 | 15 |
| MgO w % | 33 | 26 | 16 | 13 |
| TPV cc/g | 0.9223 | 0.5127 | 0.7212 | 0.5532 |
| PV > 1500Å cc/g | 0.0104 | 0.0357 | 0.0114 | 0.0077 |
| PV > 500Å cc/g | 0.3880 | 0.0430 | 0.0143 | 0.0115 |
| PV > 250Å cc/g | 0.4646 | 0.0762 | 0.0148 | 0.0078 |
| PV > 100Å cc/g | 0.5676 | 0.1735 | 0.2200 | 0.0864 |
| PV < 100Å cc/g | 0.3543 | 0.3392 | 0.5012 | 0.4668 |
| Pore Mode Å | | | | |
| dv/dD | 62 | 57 | 61 | 62 |
| BET | 64 | 56 | 36 | 64 |
| TSA $m^2/g$ | 318 | 243 | 330 | 278 |
| (I-A/Al) int | — | 0.009 | — | 0.005 |
| (VI-B/Al) int | — | 0.083 | — | 0.076 |
| (VIII/Al int | — | 0.018 | — | 0.016 |
| VI-B Gradient | — | 2.3 | — | 4.9 |
| VIII Gradient | — | 2.9 | — | 14.3 |

TABLE

| Property | Support Ex V | Catalyst Ex V | Support Ex VI* | Catalyst Ex VI* |
|---|---|---|---|---|
| DHT-4A w % | 25 | 19 | 25 | 20.5 |
| $K_2O$ w % | 0 | 4.7 | 0 | 0 |
| CoO w % | 0 | 3 | 0 | 3 |
| $MoO_3$ w % | 0 | 15 | 0 | 15 |
| MgO w % | 16 | 12.4 | 16 | 13 |
| TPV cc/g | 0.7212 | 0.5339 | 0.7212 | 0.5732 |
| PV > 1500Å cc/g | 0.0114 | 0.0069 | 0.0114 | 0.0088 |

TABLE-continued

| Property | Support Ex V | Catalyst Ex V | Support Ex VI* | Catalyst Ex VI* |
|---|---|---|---|---|
| PV > 500Å cc/g | 0.0143 | 0.0096 | 0.0143 | 0.0151 |
| PV > 250Å cc/g | 0.0148 | 0.0232 | 0.0148 | 0.0544 |
| PV > 100Å cc/g | 0.2200 | 0.1021 | 0.2200 | 0.1541 |
| PV < 100Å cc/g | 0.5012 | 0.4318 | 0.5012 | 0.4191 |
| Pore Mode Å | | | | |
| dv/dD | 61 | 62 | 61 | 63 |
| BET | 63 | 63 | 63 | 63 |
| TSA $m^2/g$ | 330 | 269 | 330 | 222 |
| (I-A/Al) int | — | 0.025 | — | — |
| (VI-B/Al) int | — | 0.071 | — | 0.079 |
| (VIII/Al int | — | 0.019 | — | 0.020 |
| VI-B Gradient | — | 2.4 | — | 2.8 |
| VIII Gradient | — | 4.5 | — | 1.8 |

TABLE

| Property | Support Ex VII* | Catalyst Ex VII* |
|---|---|---|
| DHT-4A w % | 50 | 41 |
| $K_2O$ w % | 0 | 0 |
| CoO w % | 0 | 3 |
| $MoO_3$ w % | 0 | 15 |
| MgO w % | 33 | 27 |
| TPV cc/g | 0.9223 | 0.5106 |
| PV > 1500Å cc/g | 0.0164 | 0.0110 |
| PV > 500Å cc/g | 0.3880 | 0.0166 |
| PV > 250Å cc/g | 0.4646 | 0.0457 |
| Pv > 100Å cc/g | 0.5676 | 0.1576 |
| PV < 100Å cc/g | 0.3543 | 0.3530 |
| Pore Mode Å | | |
| dv/dD | 62 | 57 |
| BET | 64 | 56 |
| TSA $m^2/g$ | 318 | 210 |
| (I-A/Al) int | — | — |
| (VI-B/Al) int | — | 0.099 |
| (VIII/Al) int | — | 0.022 |
| VI-B Gradient | — | 2.5 |
| VIII Gradient | — | 1.8 |

TABLE

| Property | Support Ex X | Catalyst Ex X |
|---|---|---|
| DHT-4A w % | — | |
| $Li_2O$ w % | 1.2 | 1.0 |
| NiO w % | — | 3.3 |
| $MoO_3$ w % | — | 15.0 |
| MgO w % | — | — |
| TPV cc/g | 0.79 | 0.62 |
| PV > 250Å cc/g | 0.06 | 0.04 |
| PV > 160Å cc/g | 0.13 | 0.10 |
| PV > 160Å cc/g | 0.66 | 0.52 |
| PV > 100Å cc/g | 0.08 | 0.04 |
| PV of 100–160Å cc/g | 0.58 | 0.48 |
| Pore Mode Å | | |
| dv/dD | 125 | 129 |
| BET | 114 | 116 |
| TSA $m^2/g$ | 218 | 174 |
| (I-A/Al) int | — | — |
| (VI-B/Al) int | — | 0.10 |
| (VIII/Al int | — | 0.015 |
| VI-B Gradient | — | 4.1 |
| VIII Gradient | — | 0.93 |

TABLE

| Property | Support Ex XI | Catalyst Ex XI |
|---|---|---|
| DHT-4A w % | — | — |
| $K_2O$ w % | — | 2.3 |
| CoO w % | — | 3 |
| $MoO_3$ w % | — | 15 |
| MgO w % | — | — |
| TPV cc/g | 0.9165 | 0.7149 |
| PV > 1500Å cc/g | 0.075 | 0.0597 |
| PV > 500Å cc/g | 0.1166 | 0.0989 |
| PV > 250Å cc/g | 0.1672 | 0.1265 |
| PV > 100Å cc/g | 0.3987 | 0.2359 |
| PV < 100Å cc/g | 0.5178 | 0.4790 |
| Pore Mode Å | | |
| dv/dD | 86 | 75 |
| BET | 77 | 72 |
| TSA $m^2/g$ | 309 | 276 |
| (I-A/Al) int | — | 0.013 |
| (VI-B/Al) int | — | 0.1 |
| (VIII/Al int | — | 0.019 |
| VI-B Gradient | — | 8.8 |
| VIII Gradient | — | 13.4 |

EXAMPLES XIV–XXVI*

Each of these catalysts is tested to determine its ability to effect hydrodesulfurization (HDS) of a model feed containing 12 mol % (0.625 molar) benzothiophene in a blend of 67.5 mol % ASTM reagent grade n-heptane with 20.5 mol % 1-hexene). In each test, the catalyst is ground to 30–60 mesh size and calcined in air at 850° F. for 2 hours. The catalyst (0.5 grams) is loaded into the reactor, presulfided with 10% $H_2S/H_2$ flowing at a rate of 50 cc/minute (corresponding to an LHSV of 4). The Model Feed is then admitted for 4 hours. The average hydrodesulfurization activity is reported as %HDS (i.e. w % of sulfur in the feed which has been removed). The percent of olefins saturated is reported as %OS.

It will be apparent the better results are indicated by high HDS and low OS. The results are tabulated as HDS/OS. Thus in Example I infra, at 650° F., the result 84.5/16.0 means that 84.5 w % of the sulfur originally present is removed and 16 w % of the olefins originally present have been saturated.

TABLE

| Example | Catalyst of Example | HDS/OS 550° F. | 600° F. | 650° F. |
|---|---|---|---|---|
| XIV | I | NA/NA | 62.0/10.9 | 84.5/16.0 |
| XV | II | 38.2/7.5 | 63.1/10.6 | 83.3/14.4 |
| XVI | III | 25.2/4.6 | 45.1/6.7 | 60.0/9.1 |
| XVII | IV | 33.7/7.8 | 58.8/11.0 | 83.5/19.8 |
| XVIII | V | 33.5/5.3 | 57.9/7.3 | 72.6/10.0 |
| XIX* | VI* | 54.7/11.6 | 72.5/17.5 | 91.5/28.2 |
| XX* | VII* | 38.5/9.3 | 62.1/15.8 | 88.5/24.6 |
| XXI* | VIII* | 22.9/4.9 | 39.6/7.3 | 62.0/12.4 |
| XXII* | IX* | 19.0/3.9 | 35.1/5.6 | 57.3/8.2 |
| XXIII* | X* | 41.1/21.4 | 71.1/33.0 | 86.9/NA |
| XXIV* | XI* | 60.1/12.6 | 88.0/20.5 | 99.9/31.6 |
| XXV* | XII* | 18.4/4.4 | 39.5/6.8 | 61.3/11.2 |
| XXVI* | XIII* | 39.8/9.0 | 67.8/17.8 | 85.5/25.7 |

NA means not attainable.

From the above Table, the following conclusions may be drawn:

(i) The Best Mode of Example XV which use the catalyst of Example II, yields at 600° F. an HDS as high as 63.1% with an OS of only 10.6%. Control Examples XIX*–XXVI* yield either significantly lower HDS or higher OS or both.

(ii) practice of the process of this invention permits attainment of HDS as high as 84.5% with satisfactorily low olefin saturation.

(iii) practice of the process of this invention permits attainment of OS as low as 4.6% with satisfactorily high HDS

EXAMPLES XXVII–XXXIX*

In this series of Examples, Olefin Saturation of the product (using a charge having an olefin content of 20 mol %) is determined, at conditions which yield 50% hydrodesulfurization and 80% hydrodesulfurization, to be as follows:

TABLE

| Example | Catalyst of Example | OS % @ 50% HDS | @ 80% HDS |
|---|---|---|---|
| XXVII | I | 8.5 | 13.4 |
| XXVIII | II | 9.2 | 14.6 |
| XXIX | III | 7.5 | 10.9 |
| XXX | IV | 10.8 | 18 |
| XXXI | V | 7.1 | 11 |
| XXXII* | VI* | 11.3 | 20.6 |
| XXXIII* | VII* | 12.1 | 21.0 |
| XXXIV* | VIII* | 9.6 | NA |
| XXXV* | IX* | 9.0 | NA |
| XXXVI* | X* | 13.7 | 27.2 |
| XXVII* | XI* | 10.6 | 17.0 |
| XXXVIII* | XII* | 9.4 | NA |
| XXXIX* | XIII* | 11.8 | 22.8 |

From this Table, the following conclusions may be drawn:

(i) At 50% HDS, experimental Examples XXVII–XXXI of this invention desirably yield OS as much as 6.6% lower than is attained in control Examples XXXII*–XXXIX*.

(ii) At 80% HDS, experimental Examples XXVII–XXXI desirably yield OS as much as 16.3% lower than is attained in control Examples XXXII*–XXXIX*.

It should be noted that in Control Examples XXXIV*, XXXV*, and XXXVIII*, it was not possible to attain (NA) the desired 80% HDS at temperatures less than those which would cause undesirable amounts of cracking (<680° F.). For Control Example XXXIX*, using a commercially available magnesia-containing catalyst (Example XIII*), the 80% level of hydrodesulfurization could only be attained at one half the normal liquid hourly space velocity producing an undesirably high level of olefin saturation of 22.8 %. Catalyst of Example II permits attainment of 80% HDS with desirably low OS (i.e. 14.6).

Analyses of the products from the above-described reactor tests using the PIANO analyses show that, under the test conditions employed, the n-heptane (n-$C_7$ fraction) passes through unchanged. The feed 1-hexene forms an isomerate with an approximately constant composition of 7.47 w %, 1-hexenes (octane number of 69.9), 67.4 w %, 2-hexenes (octane number of 86.8) and 25.2 w % 3-hexenes (octane number of 87.1). The octane number of the total $C_6$ isomerate is 85.6

To some degree, this $C_6$ isomerate (average octane number of 85.6) is saturated to form n-hexane (octane number of 25.5). Saturation causes a loss in octane number—defined as 0.5 (RON+ MON). The remaining $C_6$ isomerate and the saturated n-hexane form the $C_6$ product fraction.

It is also a feature of the process of this invention that it is characterized by smaller loss in octane number, i.e. 0.5

RON+MON, for the $C_6$ product fraction.

TABLE

| Example | Catalyst of Example | 50% HDS Octane No. | 50% HDS Loss | 80% HDS Octane No. | 80% HDS Loss |
|---|---|---|---|---|---|
| XL | I | 80.5 | 5.1 | 77.5 | 8.1 |
| XLI | II | 80.1 | 5.5 | 76.8 | 8.8 |
| XLII | III | 81.1 | 4.5 | (79.0 ←Est→ 6.6) | |
| XLIII | IV | 79.1 | 6.5 | 74.4 | 11.2 |
| XLIV | V | 81.3 | 4.3 | (78.6 ←Est→ 7.0) | |
| XLV | VI* | 78.8 | 6.8 | 73.2 | 12.4 |
| XLVI | VII* | 78.3 | 7.3 | 73.0 | 12.6 |
| XLVII | VIII* | 79.8 | 5.8 | NA | NA |
| XLVIII | IX* | 80.2 | 5.4 | NA | NA |
| XLIX | X* | 77.4 | 8.2 | 69.3 | 16.3 |
| L | XI* | 79.2 | 6.4 | 75.7 | 9.9 |
| LI | XII* | 80.0 | 5.6 | NA | NA |
| LII | XIII* | 78.5 | 7.1 | 71.9 | 13.7 |

From the above Table, it is apparent that with a $C_6$ olefin charge forming a $C_6$ olefin isomerate having an octane number of 85.6, it is possible to operate (in Examples XXVII–XXVIII) in accordance with practice of this invention at high levels of HDS with a loss in octane number of only 8.1–8.8 for the $C_6$ product fraction. In control Examples such as Examples XLV*–LII* high levels of HDS could not be achieved. In evaluations of control Example LII*, at one half the normal liquid space velocity, an undesirable loss in octane number of 13.7 for the $C_6$ product fraction was observed at high levels of HDS.

From the above, it is clear that control catalysts require a much lower liquid hourly space velocity (i.e. a much larger sized reactor) to achieve high levels (i.e. ≧80%) of HDS compared to the process of the instant invention. It is also clear that the process of the instant invention desirably effects lesser saturation of olefins; and it suffers a lower octane loss at high levels of HDS than do processes utilizing prior art catalysts.

In Example XLIII, it is shown to be possible to operate in accordance with this invention at high HDS levels with a loss in octane number of only 11.2 for the $C_6$ product fraction.

It is further apparent from the above Table that even lower levels of loss of Octane Number (6.6 for Example XLII with a higher level of DHT-4A in the support and 7.0 for Example XLIV with higher levels of potassium) could be achieved at high levels of HDS. In control Examples XLVII, XLVIII and LI, the high levels of HDS could not be achieved. In evaluations of control Examples XLV* and XLVI*, without the addition of potassium—i.e., as is required by the catalysts of the instant invention—a loss in Octane Number of 12.4–12.6 was obtained at high levels of HDS. In evaluations of control Example XLIX*, a loss in Octane Number of 16.3 was obtained at high levels of HDS. In evaluations of control Example L*, without the incorporation of a hydrotalcite-like compound into the catalyst support—i.e., as is required by the catalysts of the instant invention—a loss in Octane Number of 9.9 was obtained at high levels of HDS. In evaluations of control Examples LII*, a commercial magnesia-containing catalyst, at ½-normal liquid hourly space velocity, a loss in Octane Number of 13.7 was obtained at high levels of HDS.

From the above discussion, it is obvious that the prior art magnesia-containing catalyst, as typified by control Example LII*, requires a much lower liquid hourly space velocity (i.e., a much larger reactor size) to achieve high levels (i.e., ≧80%) of HDS compared to the process of the instant invention. It is also obvious that the process of the instant invention saturates less olefins and suffers a lower loss in Octane Number at high levels of HDS compared to the prior art magnesia-containing catalyst as typified in control Example LII*.

Although this invention has been illustrated by reference to specific embodiments, it will be apparent to those skilled in the art that various changes and modifications may be made which clearly fall within the scope of the invention.

What is claimed is:

1. A catalyst composition comprising an alkali metal, a non-noble Group VIII metal, and a metal of Group VI-B on an inert support containing a hydrotalcite composition represented by the formula:

$$[X_aY_b(OH)_c]_n[A]_d \cdot e \cdot H_2O$$

where a=1–10 b=1–10 c=2 (a+b)=4–40

A is an anion of formal negative charge n=an integer 1–4 d is the formal positive charge of $[X_a\ Y_b\ (OH)_c]$ e=1–10

X is a divalent metal

Y is a trivalent metal of Group III or Group VI-B or non-noble Group VIII of the Periodic Table, subject to the qualification that when one of d or n is an integral multiple of the other, they are both reduced to lowest integral terms.

2. The catalyst composition of claim 1 which further comprises 0.1–6 wt % of alkali metal, 0.1–6 wt % of non-noble Group VIII metal, and 0.1–25wt % of Group VI-B as oxides on an inert support of alumina containing $$Mg_{4.5}Al_2OH_{13}CO_3.3.5H_2O.$$

3. The catalyst composition of claim 2, wherein said catalyst is further characterized by a Total Pore Volume of 0.5–1 cc/g, a Pore Size Distribution such that 0.05–0.6 cc/g is present as pores of greater than 100Å and 0.25–0.6 cc/g is present as pores of less than 100Å and the Total Surface Area of the catalyst is 200–350 square meters per gram.

4. The catalyst composition of claim 3 which has been calcined twice at temperatures between 800° and 1200° F.

5. A catalyst composition as claimed in claim 1 wherein said alkali metal is present in amount of 0.1–6 w % of total catalyst.

* * * * *